US009567862B2

(12) United States Patent
Sonoda et al.

(10) Patent No.: US 9,567,862 B2
(45) Date of Patent: Feb. 14, 2017

(54) VANE PROFILE FOR AXIAL-FLOW COMPRESSOR

(71) Applicant: HONDA MOTOR CO., LTD., Tokyo (JP)

(72) Inventors: Toyotaka Sonoda, Wako (JP); Toshiyuki Arima, Wako (JP); Giles Endicott, Offenbach/Main (DE); Markus Olhofer, Offenbach/Main (DE)

(73) Assignee: HONDA MOTOR CO., LTD., Tokyo (JP)

( * ) Notice: Subject to any disclaimer, the term of this patent is extended or adjusted under 35 U.S.C. 154(b) by 530 days.

(21) Appl. No.: 14/084,763

(22) Filed: Nov. 20, 2013

(65) Prior Publication Data

US 2014/0161606 A1 Jun. 12, 2014

(30) Foreign Application Priority Data

Dec. 12, 2012 (DE) ..... 10 2012 222 953

(51) Int. Cl.
*F01D 9/02* (2006.01)
*F04D 29/32* (2006.01)
*F04D 29/68* (2006.01)

(52) U.S. Cl.
CPC ..... *F01D 9/02* (2013.01); *F04D 29/324* (2013.01); *F04D 29/681* (2013.01)

(58) Field of Classification Search
CPC ..... F01D 9/02; F01D 5/14; F04D 29/681; F04D 29/324
See application file for complete search history.

(56) References Cited

U.S. PATENT DOCUMENTS 4,108,573 A 8/1978 Wagner
5,492,448 A * 2/1996 Perry ..... B64C 3/14 416/228

(Continued)

FOREIGN PATENT DOCUMENTS

EP 0244334 11/1987
EP 1939399 7/2008

(Continued)

OTHER PUBLICATIONS

Orufofaa, JP2001165095 (Machine translation), 2001.*
Partial of European Search Report dated Apr. 15, 2014, 2 pages.

*Primary Examiner* — Craig Kim
*Assistant Examiner* — Eldon Brockman
(74) *Attorney, Agent, or Firm* — Rankin, Hill & Clark LLP

(57) ABSTRACT

A vane for an axial-flow compressor has a pressure surface generating positive pressure and a suction surface generating negative pressure, and both are located on one side of the chord line. The pressure surface includes a bulging portion, having a maximum curvature of 1.5 or more between a chordal position of 70% and 95%, in a central section of the vane's span. This configuration increases the flow velocity around the bulging portion of the pressure surface to locally decrease the static pressure. By flow continuity the flow velocity on the suction surface that faces the pressure surface is decreased, and thus locally the static pressure on the suction surface is increased. Secondary flow from the pressure surface with positive pressure to the suction surface with negative pressure from the hub region, is suppressed due to the locally increased static pressure on the suction surface.

1 Claim, 7 Drawing Sheets

(56) References Cited

U.S. PATENT DOCUMENTS

Figure 5:
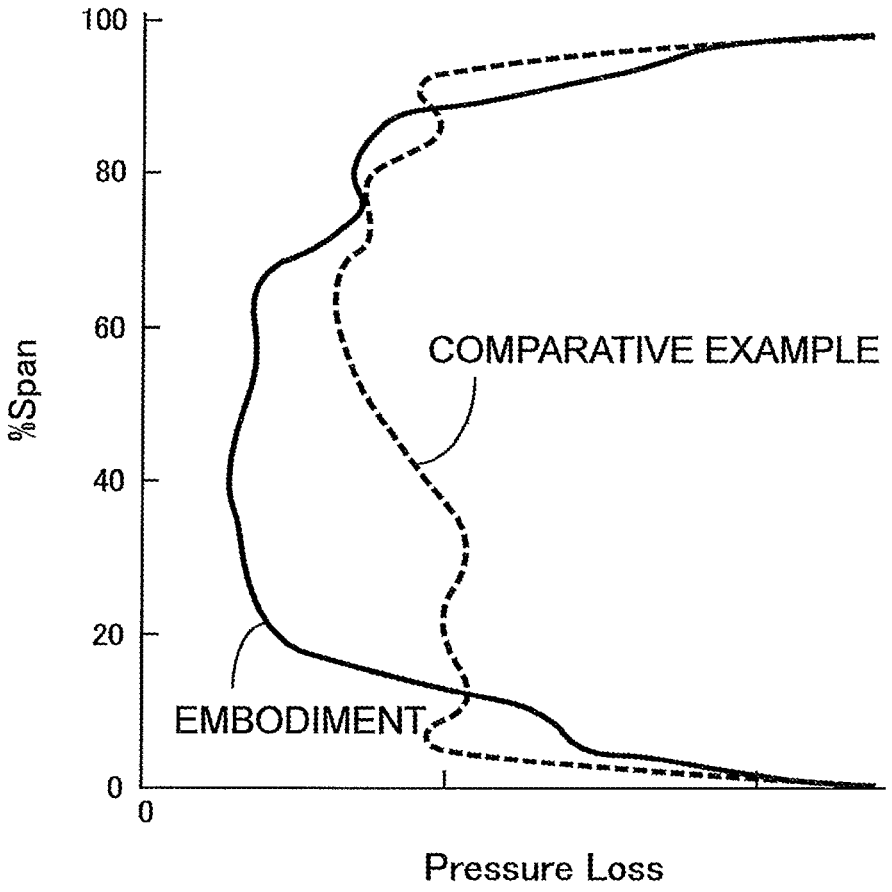

| | | | | |
|---|---|---|---|---|
| 6,905,309 | B2 * | 6/2005 | Nussbaum | F01D 5/10 29/889.1 |
| 2006/0275134 | A1 * | 12/2006 | Hasenjager | F01D 5/141 416/237 |
| 2011/0200442 | A1 | 8/2011 | Routier | |
| 2012/0230834 | A1 | 9/2012 | Cornelius et al. | |

FOREIGN PATENT DOCUMENTS

| | | |
|---|---|---|
| FR | 2867506 | 9/2005 |
| JP | 2001-165095 | 6/2001 |

* cited by examiner

FIG.1 (EMBODIMENT)
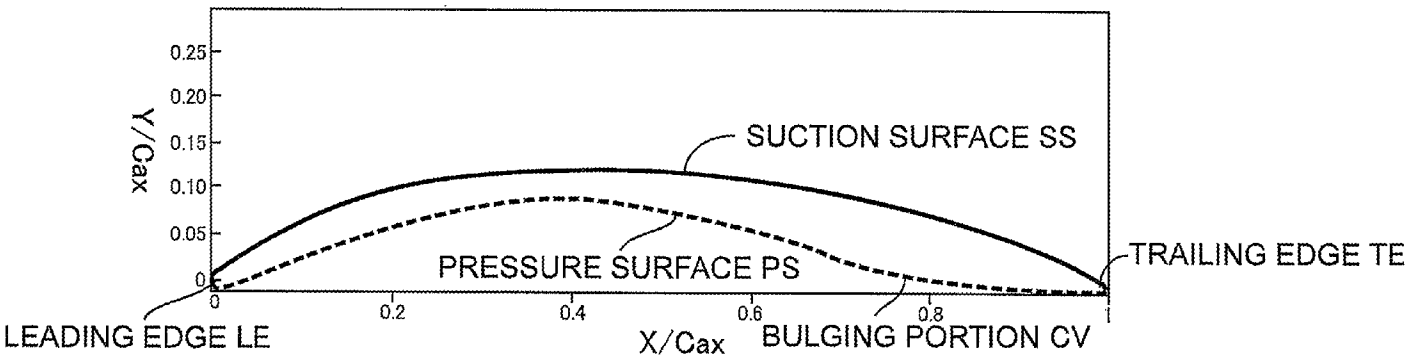
FIG.2 (EMBODIMENT)
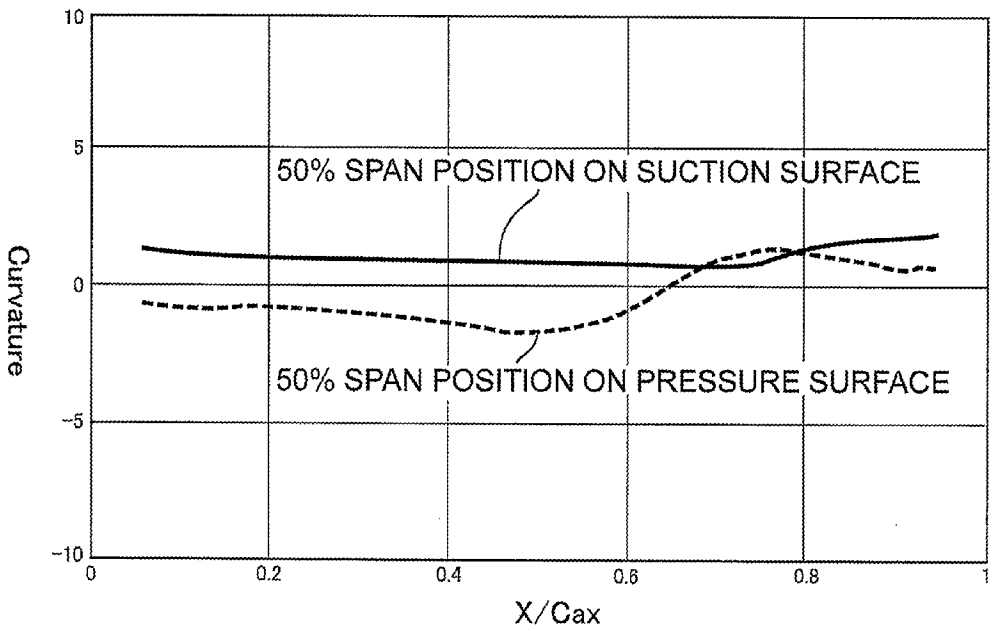

FIG.3 (EMBODIMENT)
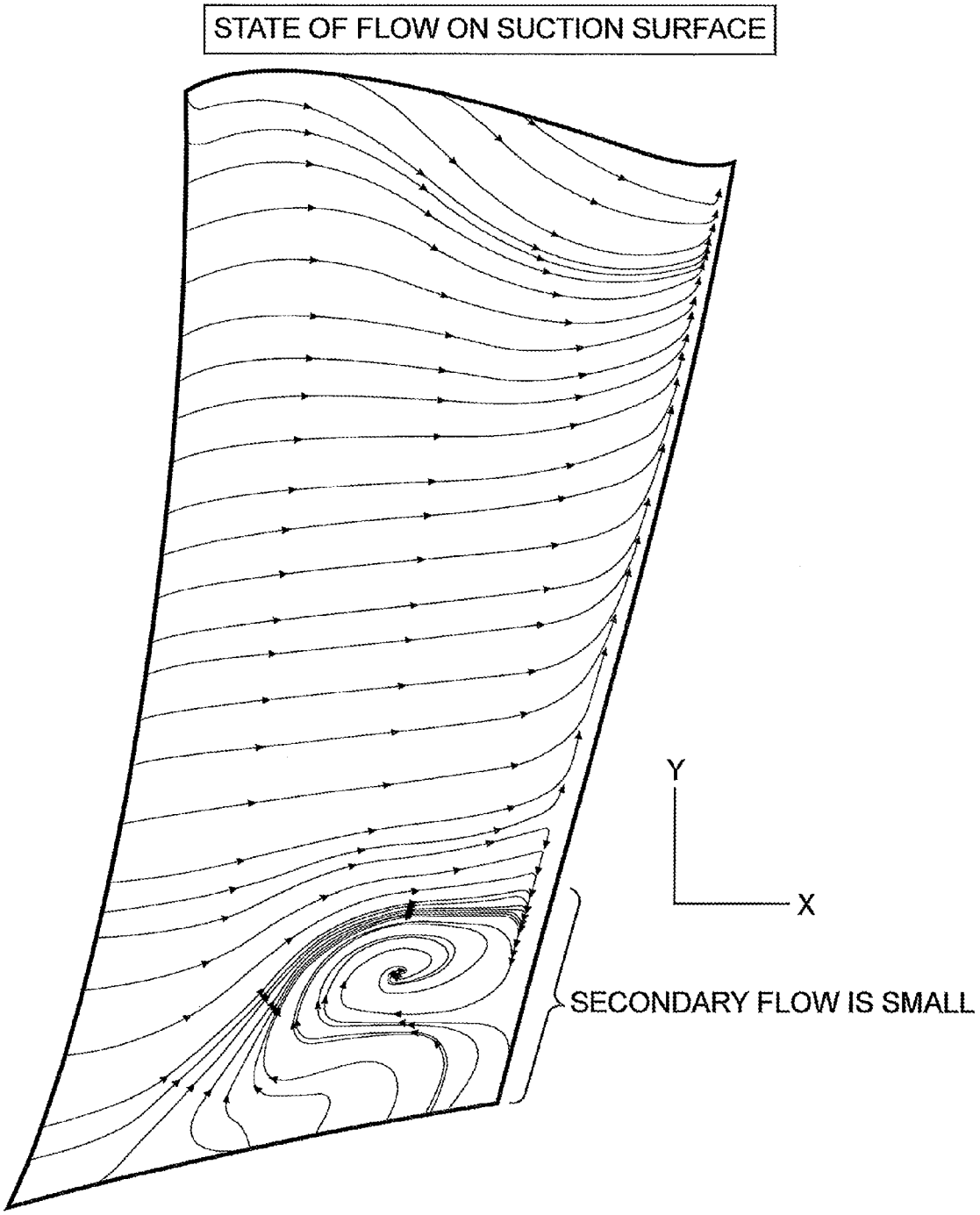

FIG.4 (EMBODIMENT)
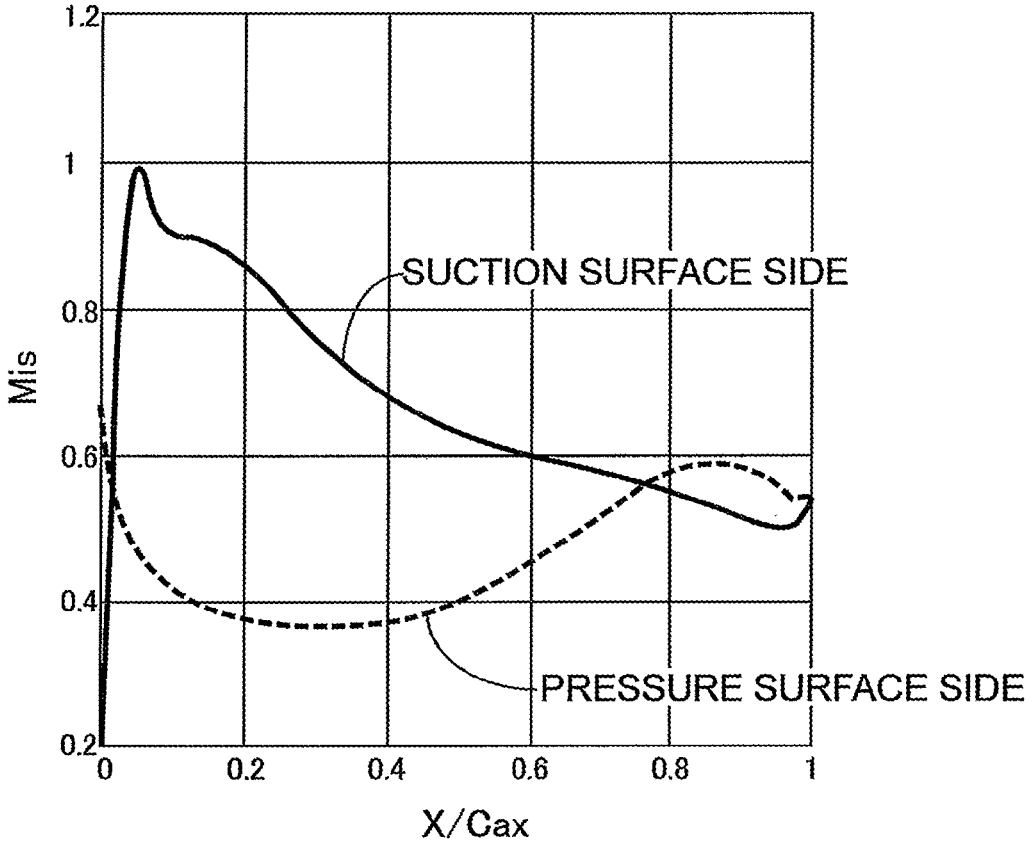

FIG.6 (COMPARATIVE EXAMPLE)
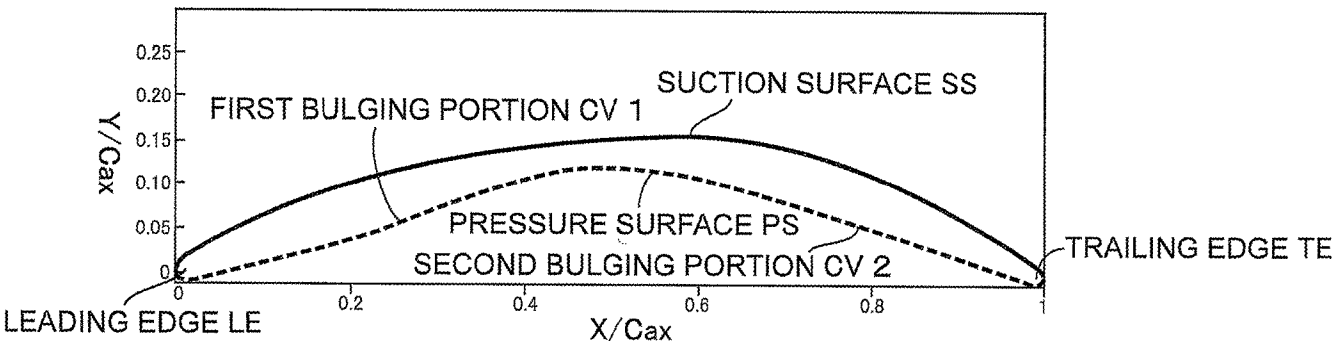
FIG.7 (COMPARATIVE EXAMPLE)
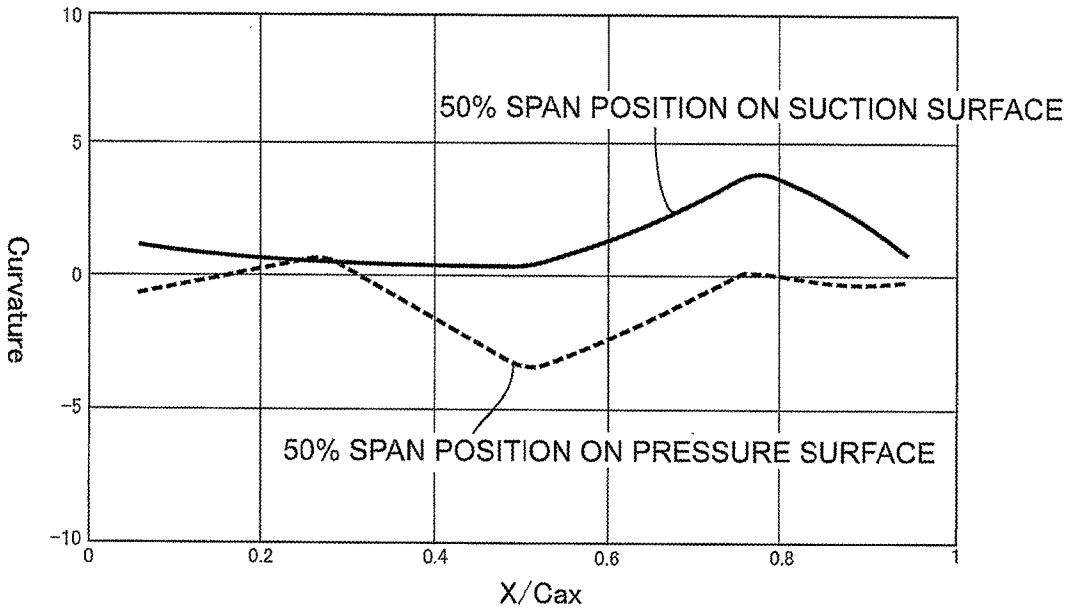

FIG.8 (COMPARATIVE EXAMPLE)
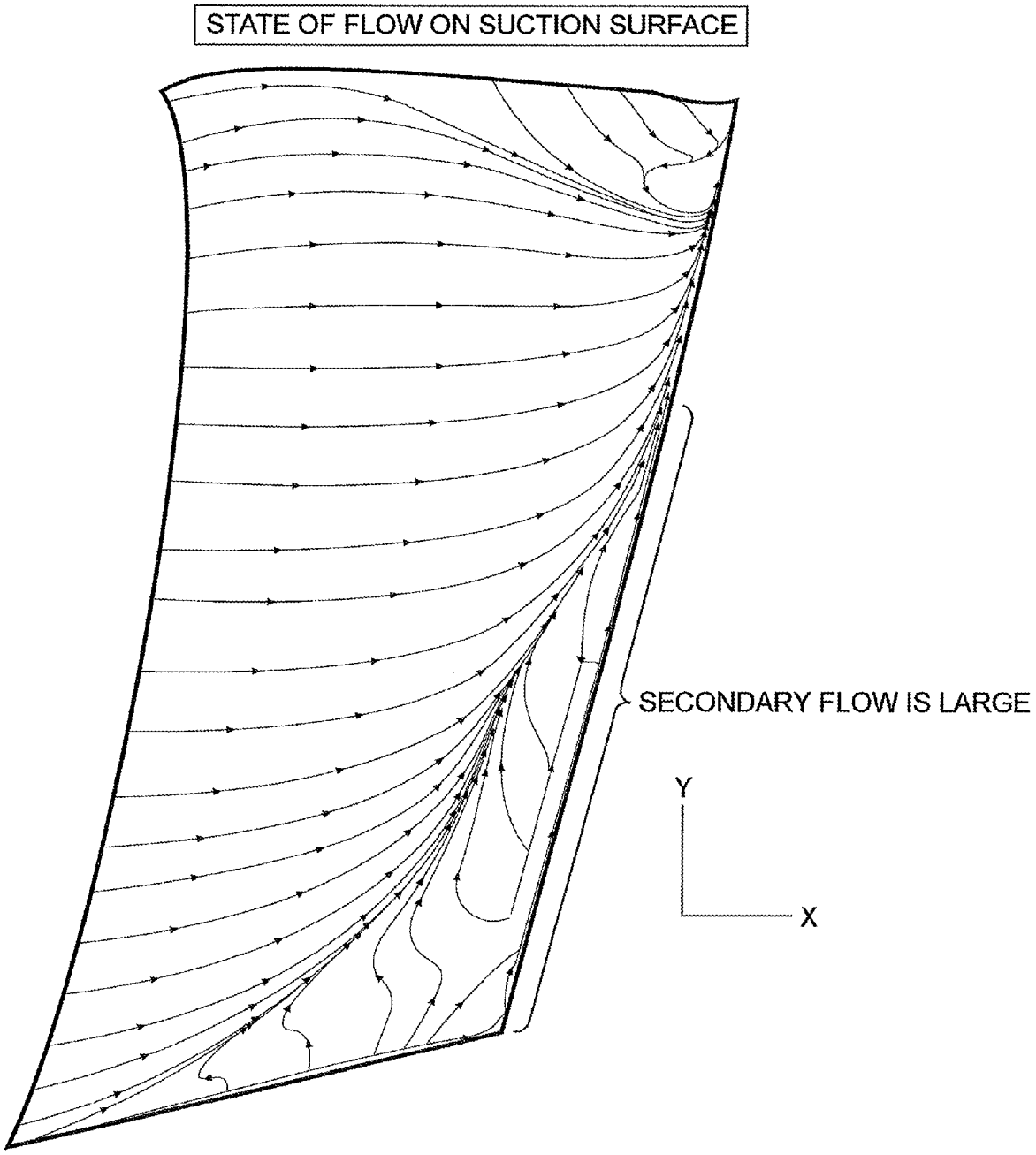

VANE PROFILE FOR AXIAL-FLOW COMPRESSOR

The present invention relates to the profile of a vane for an axial-flow compressor in which a pressure surface generating a positive pressure and a suction surface generating negative pressure are both located on one side of the chord line.

Japanese Patent Application Laid-open No. 2001-165095 filed by the present applicant discloses the profile of a stator vane for such an axial-flow compressor. As shown in FIG. 6, the vane profile (hereinafter, referred to as Comparative Example) disclosed in FIG. 3 of Japanese Patent Application Laid-open No. 2001-165095 has a first bulging section (CV1) and a second bulging section (CV2) at a position close to the leading edge (LE) and a position on the trailing edge (TE) respectively, on the pressure surface (PS), which generates positive pressure. Separation is generated in the boundary layer on the pressure surface (PS) by the first bulging section (CV1), thereby weakening the generation of shock waves on the suction surface (SS) to reduce wave drag. In addition, the boundary layer destabilized by the first bulging section (CV1) is stabilized again by the second bulging portion (CV2), thereby making it possible to minimize the increase of friction drag caused by the boundary layer separation on the pressure surface (PS).

Meanwhile, a multitude of stator vanes in an axial-flow compressor are arranged radially to extend from the central hub outward in a radial/spanwise direction. Since the pressure surface (PS) and suction surface (SS) of two adjacent vanes face each other with only a small separation between them, a secondary flow is generated, which flows along the hub wall from the pressure surface (PS) of one stator vane to the adjacent suction surface (SS). This secondary flow increases the pressure loss of stator vanes. FIG. 8 shows the surface flowpath of the working fluid on the suction surface side of the vane denoted Comparative Example, from which it can be seen that a large secondary flow directed outward in the spanwise direction is generated from the hub region.

Although a small secondary flow directed inward in the spanwise direction is also generated in the tip region in addition to the previously described large secondary flow in the hub region, it can be considered that since the secondary flow at the tip is considerably smaller than the secondary flow at the hub, the secondary flow at the tip has only a small influence on the pressure loss of the stator vanes.

To suppress the above-described large secondary flow directed outward in the span direction, generated in the hub region, it is only necessary to block the secondary flow by locally increasing the static pressure of the suction surface in a central section of the blade's span. In other words, since the pressure surface and the suction surface of two circumferentially adjacent stator vanes face each other, separated by only a small distance, it is only necessary to locally decrease the static pressure on the pressure surface facing the suction surface in order to locally increase the static pressure on the suction surface. This is because when the flow rate of the fluid flowing through the inter-blade passage between the pressure surface and the suction surface has a constant cross-sectional area, a decrease of the static pressure together with an increase of the flow velocity on the pressure surface side results in an increase of the static pressure on the suction surface along with a decrease in the flow velocity. Since stator vanes forming a cascade are arranged to be swept in the axial direction, a rear portion of the pressure surface of each adjacent two stator vanes is normal to a central portion of the adjacent vane's suction surface (SS) with only a small separating distance. For this reason, the flow velocity on the rear portion of the pressure surface strongly influences the flow velocity on the mid-chord section of the suction surface.

As shown in FIG. 7, the profile of the Comparative Example is such that the second bulging portion (CV2) located close to the trailing edge (TE) of the pressure surface (PS) has a curvature of only 0.2, thus it is nearly flat. As a result, the flow velocity along the second bulging portion (CV2) is kept near constant, so that the static pressure is not significantly decreased, and thus the static pressure on the suction surface facing the second bulging portion (CV2) is not significantly increased. As a result, it is difficult to effectively suppress the secondary flow on the suction surface (SS) to reduce the pressure loss of the vane.

Note that the quantitative curvature data presented in the present specification is C/R, obtained by non-dimensionalizing the radius of curvature R, with the chord length of the vane, C.

The present invention has been made in light of the above-described understanding, and the primary object of the present invention is to reduce the pressure loss of a vane for an axial-flow compressor by suppressing secondary flow on its suction surface.

In order to achieve the aim, according to an invention described in claim 1, a vane profile for an axial-flow compressor is provided in which a pressure surface (PS) generates positive pressure and a suction surface (SS) generates negative pressure and both are located on the same side of the chord line, with a central section of the pressure surface (PS) in the spanwise direction including a bulging portion having a maximum curvature of 1.5 or more between a chord of 70% and a 95%.

According to the above-described configuration, in the vane profile for an axial-flow compressor, the pressure surface (PS) which generates a positive pressure and the suction surface (SS) which generates negative pressure are both located on the same side of the chord line. As the central section of the pressure surface (PS) in the spanwise direction, includes the bulging portion having the maximum curvature of 1.5 or more between 70% and 95% chord position, the vane profile increases the flow velocity around the bulging portion of the pressure surface (PS) to locally decrease the static pressure, thereby causing a reduction in the flow velocity on the suction surface (SS) facing the pressure surface (PS) to locally increase its static pressure. As a result, the secondary flow, which would flow from the hub region of the pressure surface (PS) with positive pressure to the suction surface (SS) at negative pressure, is suppressed as the static pressure is locally increased on the central section in the spanwise direction of the suction surface (SS), cutting the pressure gradient, and thus the pressure loss caused by the secondary flow can be reduced.

According to the invention described in claim 2, in addition to the configuration according to claim 1, the profile of a vane for an axial-flow compressor is provided, wherein the central section in the spanwise direction is located between a spanwise position of 40% to 60%.

According to the above-described configuration, the vane profile including the bulging portion on the pressure surface (PS) having the maximum curvature of 1.5 or more between the 70% and 95% chord position is employed in the region with a span between 40% and 60% of the vane. Accordingly, the pressure loss can be significantly reduced by effectively suppressing the secondary flow directed outward radially on the suction surface (SS).

The above and other aims, characteristics, and advantages of the present invention will be clear from the description of a preferred embodiment which will be described in detail in conjunction with the accompanying drawings.

Hereinafter, an embodiment of the present invention will be described with reference to the accompanying drawings.

FIGS. 1 to 5 show an embodiment of the present invention. FIG. 1 is a diagram showing the vane profile of a stator vane for an axial-flow compressor. FIG. 2 is a diagram showing the curvature distribution of the pressure (PS) and suction surfaces (SS) of the vane profile. FIG. 3 is a diagram showing the surface flow pattern on the suction surface (SS) of the stator vane. FIG. 4 is a diagram showing flow velocity distributions on the pressure surface (PS) and the suction surface (SS) of the vane profile. FIG. 5 is a graph showing the reduction in pressure loss by the embodiment.

Figure 9:
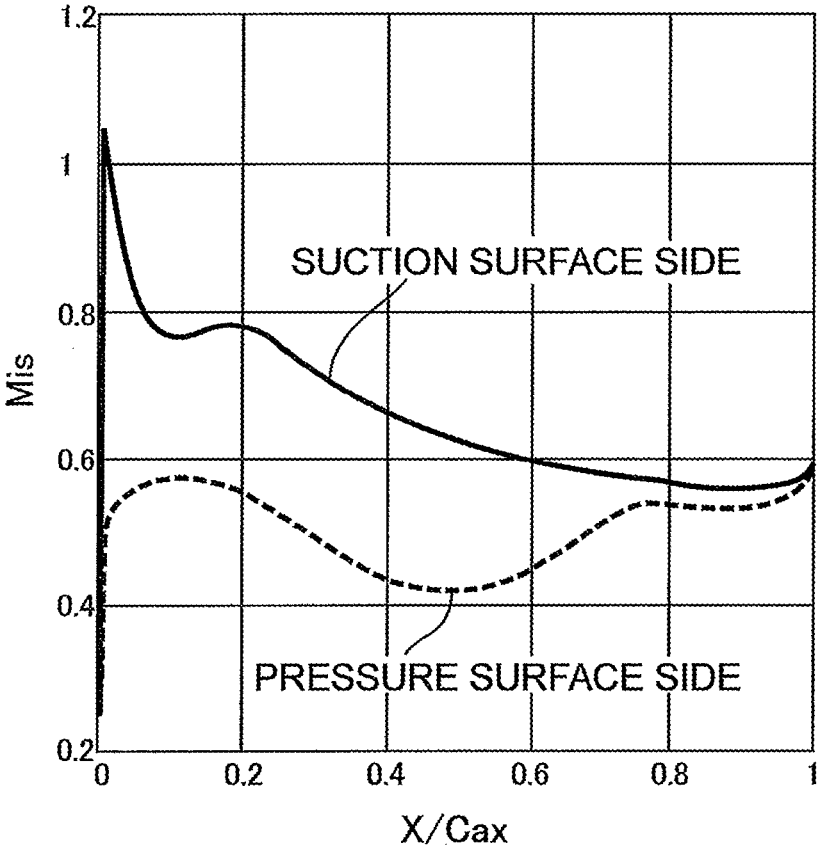

FIGS. 6 to 9 relate to the Comparative Example. FIG. 6 is a diagram showing a vane profile for a stator within an axial-flow compressor. FIG. 7 is a diagram showing curvature distributions of the pressure (PS) and suction surfaces (SS) of the vane profile. FIG. 8 is a diagram showing the surface flow on the suction surface (SS) of the stator vane. FIG. 9 is a diagram showing the flow velocity distribution on the pressure surface (PS) and the suction surface (SS) of the vane profile.

The vane profile of the embodiment is employed between a 40% and 60% spanwise position of a stator vane of an axial-flow compressor. FIG. 1 shows the vane profile at a 50% span position, and FIG. 2 shows the curvature distribution for the pressure surface (PS) and suction surface (SS) of the vane profile. The vane profile of the embodiment has the suction surface (SS) and the pressure surface (PS) on one side of a chord line. The curvature of the suction surface (SS) is predominantly constant, approximately 1.0 from the leading edge (LE) to approximately a 75% chord position, and is then gradually increased to approximately 2.0 from around the 75% chord position to the trailing edge (TE). The curvature of the pressure surface (PS) is gradually decreased from approximately −1.0 to approximately −2.0 from the leading edge (LE) to a point close to 50% chord position, and is then gradually increased to reach the maximum value of 1.5 at the 75% chord position, and is thereafter gradually decreased to approximately 1.0 toward the trailing edge (TE). The feature of the vane profile of the embodiment is that the vane profile includes a bulging portion (CV) having a maximum curvature of 1.5 in a rear portion of the pressure surface (PS).

FIG. 4 shows flow velocity distributions on the suction surface (SS) and the pressure surface (PS) of the vane profile of the embodiment. The flow velocity distribution on the suction surface (SS) is gradually decreases from the leading edge (LE) to the trailing edge (TE) while the flow velocity distribution on the pressure surface (PS) gradually decreases from the leading edge (LE) to be a minimum value near the 50% chord position, then gradually increases to be a maximum value near the 88% chord position, and thereafter gradually decreases toward the trailing edge (TE). The maximum value of the flow velocity near the 88% chord position is the result of the bulging portion (CV) on the pressure surface (PS). Between 75% chord, and 100% chord i.e the trailing edge (TE), the flow velocity on the pressure surface (PS) exceeds that of the suction surface (SS).

FIGS. 6 and 7 show a vane profile of Comparative Example and curvature distributions for the pressure surface (PS) and suction surface (SS) of this vane. The vane profile of the Comparative Example includes a first bulging portion (CV1) and a second bulging portion (CV2) in a front portion and a rear portion of the pressure surface (PS) respectively. The maximum curvature of the first bulging portion (CV1) is approximately 1.0 while the maximum curvature of the second bulging portion (CV2) is approximately 0.2, which is very small.

FIG. 9 shows flow velocity distributions on the suction surface (SS) and the pressure surface (PS) of the Comparative Example vane. The flow velocity is approximately constant behind the 75% chord position corresponding to the second bulging portion (CV2) in the pressure surface (PS). This is because the second bulging portion (CV2) has a maximum curvature of approximately 0.2 and is thus nearly flat.

FIGS. 3 and 8 show the surface flow on the suction surface (SS) of the vane of the embodiment and the vane of the Comparative Example respectively. It can be seen that the area of the secondary flow from the hub region (vane root) toward the tip (vane edge) on the suction surface (SS) is large in the Comparative Example vane shown in FIG. 8 while the area of the secondary flow is significantly reduced in the embodiment shown in FIG. 3.

This is because the flow around adjacent stator vanes arranged side by side in the peripheral direction interferes with each other. Since the flow rate of the fluid flowing between the vanes is constant, an increase of the flow velocity on the pressure surface (PS) due to the influence of the bulging portion (CV) decreases the flow velocity on the suction surface (SS) facing the pressure surface (PS), increasing the static pressure on the suction surface (SS). The vane profile of the embodiment is employed between a 40% and 60% spanwise position on the stator vane. For this reason, an increase of the static pressure on the suction surface (SS) in the central section spanwise blocks the secondary flow from the facing pressure surface (PS) toward the suction surface (SS) from the hub region, resulting in a decrease in the volume of the secondary flow.

By contrast, the vane profile of the Comparative Example has little curvature on the second bulging portion (CV2) on the pressure surface (PS), which does not cause an increase of the flow velocity and thus does not cause a decrease of the flow velocity on the opposite suction surface (SS). For this reason, there is no expectation of an increase of the static pressure on the suction surface (SS). Therefore, the secondary flow generated on the suction surface (SS) cannot be suppressed by an increase of the static pressure, and as a result, the volume of the secondary flow is increased.

FIG. 5 shows distributions of pressure loss in the spanwise direction of the vane profile of the embodiment and the vane profile of the Comparative Example. The vane of the embodiment exhibits a higher pressure loss in the hub region (in this case from the 0% to 12% spanwise position) and in a part of the tip region (from 88% to 100% spanwise position) than the vane of the Comparative Example, but exhibits lower pressure loss in the other large region (between 12% and 88% spanwise position) than the vane of the Comparative Example. As a whole, the vane profile of the embodiment achieves a large reduction in pressure loss.

Although an embodiment of the present invention has been described so far, various modifications in design can be made to the present invention without departing from the gist of the present invention.

For example, although the maximum curvature of the bulging portion (CV) of the embodiment is 1.5, the maximum curvature may be any value of 1.5 or more.

Moreover, the position of the maximum curvature is not limited to the 75% chord position in the embodiment, and may be any position between the 70% chord position and the 95% chord position.

The invention claimed is:

1. A vane profile for an axial-flow compressor in which a pressure surface (PS) which generates positive pressure and a suction surface (SS) which generates negative pressure are both located on one side of a chord line, wherein a central section in a spanwise direction, of the pressure surface (PS), which is located between a 40% and 60% spanwise position, includes a bulging portion (CV) located on the one side of the chord line having a curvature of 1.5 between a 70% and 95% chordal position.

* * * * *